United States Patent [19]

Binder

[11] Patent Number: 4,716,864

[45] Date of Patent: Jan. 5, 1988

[54] CAMSHAFT DRIVE FOR AN INTERNAL COMBUSTION ENGINE

[75] Inventor: Robert Binder, Schwieberdingen, Fed. Rep. of Germany

[73] Assignee: Dr. Ing. h.c.F. Porsche Aktiengesellschaft, Stuttgart, Fed. Rep. of Germany

[21] Appl. No.: 884,657

[22] Filed: Jul. 15, 1986

Related U.S. Application Data

[63] Continuation of Ser. No. 742,111, Jun. 6, 1985, abandoned.

[30] Foreign Application Priority Data

Jun. 6, 1984 [DE] Fed. Rep. of Germany ..... 3421028

[51] Int. Cl.[4] ..... F01L 1/26

[52] U.S. Cl. ..... 123/90.31; 123/90.27

[58] Field of Search ..... 123/90.27, 90.31

[56] References Cited

U.S. PATENT DOCUMENTS

| | | | |
|---|---|---|---|
| 2,010,056 | 8/1933 | Brush | 123/90.27 |
| 3,361,000 | 1/1968 | Buchwald | 123/90.31 |
| 4,190,025 | 2/1980 | Wahl | 123/90.31 |
| 4,480,603 | 11/1984 | Tsuboi | 123/90.27 |

FOREIGN PATENT DOCUMENTS

| | | | |
|---|---|---|---|
| 2249310 | 4/1974 | Fed. Rep. of Germany | 123/90.27 |
| 144614 | 8/1983 | Japan | 123/90.31 |
| 15612 | 1/1984 | Japan | 123/90.27 |
| 70820 | 4/1984 | Japan | 123/90.31 |
| 211705 | 11/1984 | Japan | 123/90.31 |
| 2128679 | 5/1984 | United Kingdom | 123/90.27 |

*Primary Examiner*—Ira S. Lazarus

*Attorney, Agent, or Firm*—Barnes & Thornburg

[57] ABSTRACT

The camshaft of an internal combustion engine is driven by a chain drive from an adjacent parallel intermediate shaft, which itself is driven with a toothed belt by the engine crankshaft. For a four valve cylinder head having two overhead camshafts, one camshaft is used as the intermediate shaft. By means of a hydraulic tensioning device applied at the chain drive, the relative rotating position of both camshafts and thus also the control time of the valves can be changed.

25 Claims, 2 Drawing Figures

CAMSHAFT DRIVE FOR AN INTERNAL COMBUSTION ENGINE

This is a continuation, of application Ser. No. 742,111 filed June 6, 1985, now abandoned.

BACKGROUND AND SUMMARY OF THE INVENTION

This invention relates generally to a camshaft drive for an internal combustion engine and more particularly to a drive arrangement for a pair of adjacently arranged parallel camshafts.

In a drive of the type that is described in German Patent Application No. P 33 09 376.8-13, toothed gearing is used which provides a driving connection from the crankshaft to the camshaft via several intermediate stages. Such toothed gearings are required for some applications for reasons of safety (for example, aircraft engines), but cause loud noise emissions and are quite costly to manufacture. Therefore, camshafts are conventionally driven by means of toothed belts which wind around a toothed belt wheel of the crankshaft and a toothed belt wheel of the camshaft. Since this toothed belt drive arranged on the front side of the internal combustion engine is at the same time used for driving several accessory apparatuses, the toothed belt is relatively long and tends to stretch during operation. This danger exists especially in the case of high-performance engines which, during acceleration, cause such a high straining and stretching of the belt that occasionally the belt may skip a tooth. The resulting change of the control time of the valves causes increased fuel consumption and higher emissions of harmful substances.

Accordingly, one objective of the present invention is the provision of a camshaft drive that eliminates unintended changes in the timing of the valves.

Another objective of the present invention is the provision of a camshaft drive that operates at a minimal noise level.

A further objective of the present invention is the provision of a camshaft drive that permits timing changes during the operation of the internal combustion engine.

An even further objective of the present invention is the provision of a camshaft drive that can be manufactured in a cost- effective manner.

These and other objectives of the present invention are attained by the provision of a camshaft drive for first and second parallel adjacent camshafts wherein the first camshaft is driven by a toothed belt driven by the crankshaft of the internal combustion engine. The second camshaft is driven by a chain drive connected with the first camshaft. The relative rotating position of each camshaft can be changed by means of a hydraulic tensioning device engageable with the chain drive. The control time of the valves of the internal combustion engine is adjusted by changing the relative rotating position of the camshafts by means of the tensioning device.

As discussed above, the toothed belt connecting the camshaft with the crankshaft in high performance engines will routinely be stretched and strained during acceleration of the engine. The lengthening of the toothed belt results in a change of the rotating position of the camshaft driven by the toothed belt. The tensioning device of the present invention compensates for the change of the rotating position of the camshaft with respect to the crankshaft which results from this lengthening of the toothed belt. The general type of chain tensioning device employed in the present invention is disclosed in German DE-OS No. 2 249 310. However, that disclosure relates to use of such a tensioning device with a long chain between the crankshaft and the camshaft. In such an arrangement, a shifting of the tensioning element by a certain amount results in a significantly smaller adjustment at the camshaft than in the case of the shorter chain drive between the camshaft and the intermediate shaft of the present invention. Since relatively large adjustments at the camshaft can be made by relatively small shifts of the tensioning elements according to the present invention, a hydraulic tensioning device can be employed which requires very little space for operation. This space advantage is particularly noticeable in an internal combustion engine having a four valve cylinder head and two overhead camshafts.

In accordance with the present invention, one camshaft is driven by the crankshaft by means of a toothed belt and this camshaft in turn drives the other camshaft by means of a chain. The chain drive with a tensioning device may be so small that it comfortably fits into the cylinder head and may be shielded to reduce noise emissions. Also, because it may be positioned in the oil bath, it is continually protected from dirt and abrasion. Advantageously, it is contemplated that the chain drive will be located in the center of the longitudinally extending camshafts. With this arrangement, the camshafts are stressed symmetrically from the center by the torque developed. Resulting torsion is only half of what it would be if the torque was introduced conventionally on the front side of the cylinder head.

Other objects, advantages and novel features of the present invention will become readily apparent when the following detailed description of the preferred embodiment is considered in conjunction with the attached drawings.

DETAILED DESCRIPTION OF THE DRAWINGS

Figure 1:
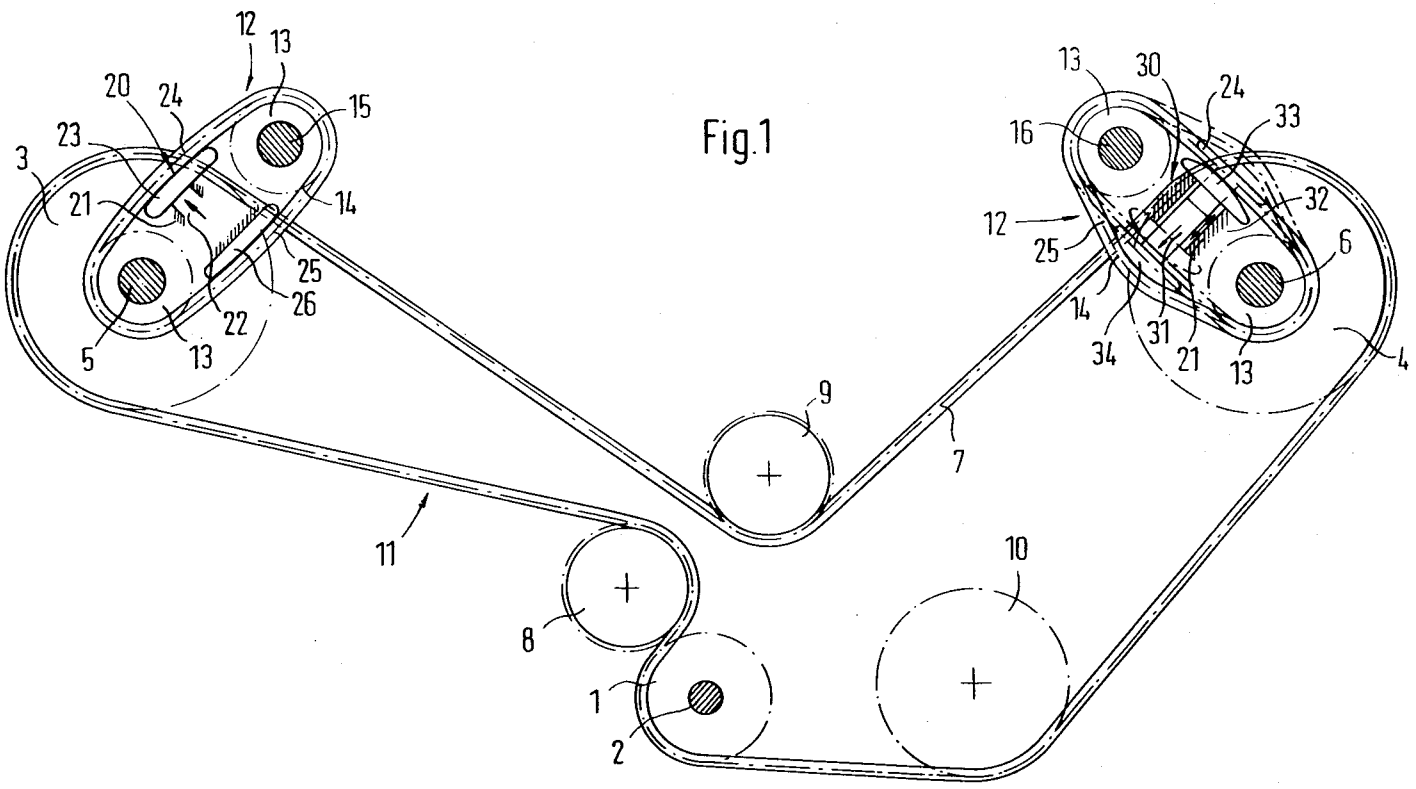
FIG. 1 shows a frontal view of a camshaft drive of an eight- cylinder V-type engine in accordance with a preferred embodiment of the present invention.
Figure 2:
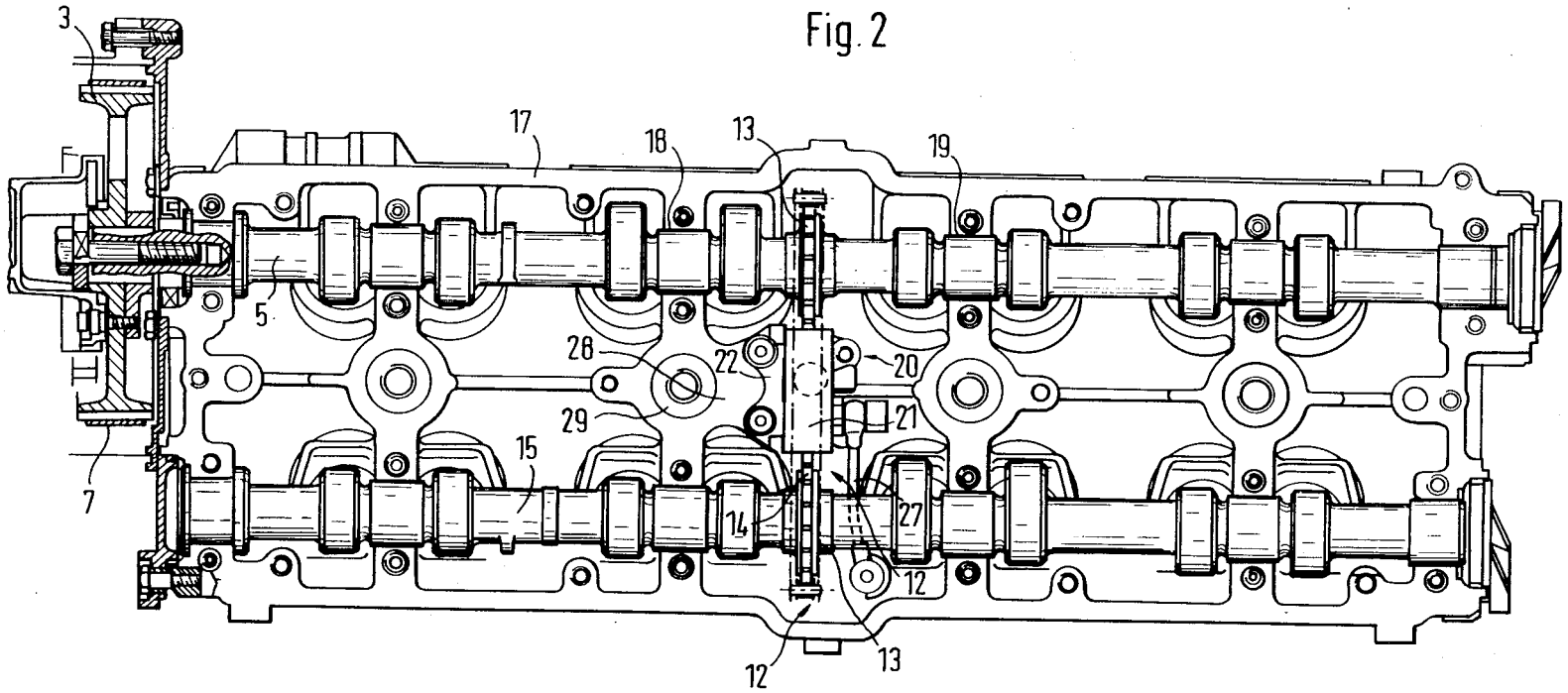
FIG. 2 shows a cross-section of a cylinder head having a camshaft drive in accordance with a preferred embodiment of the present invention.

A toothed belt 7 is wound around a toothed gear 1 of a camshaft 2 and the toothed gears 3 and 4 of the outer camshafts 5 and 6 of an eight cylinder V-type engine. By means of tensioning rollers 8, 9 and 10, the toothed belt 7 contacts the toothed gears with the appropriate contact area. By means of this toothed drive belt 11, arranged at the crankcase of the internal combustion engine, several accessory instruments (not shown) are driven at the same time. The camshafts 5 and 6, disposed longitudinally above the rows of cylinders, drive the two inside camshafts 15 and 16 disposed along the cylinder rows via chain drive 12. Each chain drive consist of two identical sprockets 13 and one chain 14 wound around them. A cylinder head 17, cast in one piece, is assigned to the four cylinders of each cylinder row. The cylinder head 17 is placed on the V-shaped crankcase and is tightly secured to it. In each cylinder 17, the two camshafts 5 and 15 are disposed in parallel at six bearing points. One camshaft is used for the control of the inlet valves, and the other one is used for control of the outlet valves. On the front side of head 17, the toothed gear 3 is centered and screwed to one camshaft 5. The chain drive 12 is arranged approximately midway between the center bearing points 18 and 19 of the camshafts. For receiving the chain drive 12, the cylinder head 17 at this point is slightly bulged.

By means of a hydraulic tensioning device 20 applied to the chain drive 12, chain 14 can be held under tension. At the same time, the relative rotating position of one camshaft with respect to the other camshaft can be adjusted in order to change the valve control times or their degree of contact.

The tensioning device 20 consists of a hydraulic piston 22 guided in a hydraulic housing 21. A plastic tensioning shoe 23 is fitted onto the hydraulic piston 22, with the tensioning shoe 23 resting against the loose side 24 of the chain 14. A stationary guide shoe 26 rests against the load end 25 of the chain 14. The guide shoe 26 is only used for guiding the chain. Hydraulic pressure is supplied via a pressure pipe 27 connected to the cylinder head 17. The hydraulic housing 21 is secured to a lateral extension 28 of spark plug housing 29 by which the spark plug is protected from splashing oil.

Instead of this tensioning device 20, a tensioning device 30 may also be provided as is shown at the chain drive 12 of the other row of cylinders in FIG. 1. Here tensioning shoes 33 and 34 are fitted onto the hydraulic piston 31 projecting a both its ends from the hydraulic housing 32. One of the tensioning shoes rests against the load end 25 of the chain 14 on its inside, and the other shoe rests against the loose end 24 of the chain 14 at its inside. When the hydraulic piston 31 is shifted longitudinally by pressure, the chain contacting area of the two sprockets 13 changes. One end is lengthened and the other end is shortened by the same amount so that the control times of the valves change, but the tension of the chain remains constant. Instead, the one tensioning element may also act on the inside of the chain, and the other tensioning element on the outside of the chain. This solution is recommended especially when tension rollers are used as the tensioning elements.

From the preceding description of the preferred embodiments, it is evident that the objects of the invention are attained, and although the invention has been described and illustrated in detail, it is to be clearly understood that the same is by way of illustration and example only and is not to be taken by way of limitation. The spirit and scope of the invention are to be limited only by the terms of the appended claims.

What is claimed is:

1. A camshaft drive for a internal combustion engine having a cylinder head with first, second, third and fourth camshafts and a crankshaft, comprising:

first flexible drive menas directly connecting said first camshaft and said third camshaft with said crankshaft for driving said first camshaft and said third camshaft, second flexible drive means connecting said first camshaft with said second camshaft for driving said second camshaft, and third flexible drive means connecting said third camshaft with said fourth camshaft for driving said fourth camshaft, said flexible drive means being all disposed at one axial end of the engine.

2. A camshaft drive according to claim 1, including tensioning means adjacent said second and third flexible drive means for changing the relative rotating position of said second camshaft with respect to said first camshaft, and said third camshaft with respect to said fourth camshaft.

3. A method of driving camshafts of an internal obustion engine having first second, third and fourth camshafts and a crankshaft comprising:

directly driving said first camshaft and said camshaft witha first flexible drive connecting said first camshaft and said third camshaft with said crankshaft, driving said second camshaft with a second flexible drive connecting said first canshaft and said second camshaft, driving said fourth camshaft with a third flexible drive connecting said third camshaft and said fourth camshaft, and said flexible drives being all disposed at one axial end of the engine.

4. A method according to claim 3, including applying tensioning means to said second and third flexible drives for changing the relative rotating position of said second camshaft with respect to said first camshaft, and said third camshaft with respect to said fourth camshaft.

5. A camshaft drive for an internal combustion engine having a cylinder head with first and second camshafts and a crankshaft, comprising:

first flexible drive means connecting said first camshaft with said crankshaft for driving said first camshaft, second flexible drive means connecting said first camshaft with said second camshaft for driving said second camshaft, and tensioning means adjacent said second flexible drive means for changing the relative rotating position of said second camshaft with respect to said first camshaft.

6. A chamshaft drive for an internal combustion engine having a cylinder head with first, second, third and fourth chamshafts and a crankshaft, comprising:

belt drive means directly connecting said first camshaft and said third camshaft with said crankshaft for driving said first camshaft and said third chamshaft first chain drive means connecting said first camshaft with said second camshaft for driving said second camshaft, and second chain drive means connecting said third camshaft with said fourth camshaft for driving said fourth camshaft.

7. A camshaft drive according to claim 6, further comprising tensioning means adjacent said chain drive means for changing the relative rotating of said second camshaft with respect to said first camshaft.

8. A camshaft drive according to claim 6, wherein said first camshaft is dispssed above a row of cylinders.

9. A camshaft drive according to claim 6, wherein said chain drive means is positioned adjacent a central region of said first camshaft.

10. A camshaft drive according to claim 7, wherein said tensioning means comprises hydraulic piston means.

11. A camshaft drive according to claim 10, further comprising tensioning shoe means on said piston means for contacting chain drive means.

12. A camshaft drive according to claim 10, whrein said piston means is displaceably arranged within hydraulic housing means.

13. A camshaft drive according to claim 10, wherein tensioning shoe means are disposed on said hydraulic piston means, one said tensioning shoe means being capable of contacting a loose end of said chain drive means, another said tensioning shoe means being capable of contacting a load end of said chain drive means.

14. A camshaft drive according to claim 10, wherein said hydraulic piston means includes tensioning roller means, one said tensioning roller means being capable of contacting a loose end of said chain drive means, another said tensioning roller means being capable of contacting a load end of said tensioning drive means.

15. A camshaft drive according to claim 12, wherein said hydraulic housing is secured to a spark plug housing of said internal combustion engine.

16. A camshaft drive according to claim 7, wherein said tensioning means comprises a first tensioning device for contacting a loose end of said chain drive means, and a second tensioning device for contacting a load end of said chain drive means.

17. A method of driving camshafts of an internal combustion engine having first, second, third and fourth camshafts and a crankshaft comprising:

directly driving said first camshaft and said third camshaft with a belt drive connecting said first camshaft and said third camshaft with said crankshaft, driving said second camshaft with a first chain drive connecting said first camshaft and said second camshaft, and driving said fourth camshaft with a second chain drive connecting said third camshaft and said fourth camshaft.

18. A method according to claim 17, further comprising applying tensioning means to said chain drive means for changing the relative rotating position of said second camshaft with respect to said first camshaft.

19. A camshaft drive for an internal combustion engine having a cylinder head with first and second camshafts and a crankshaft, comprising:

belt drive means connecting said first camshaft with said crankshaft for driving said first camshaft, chain drive means connecting said first camshaft with said second camshaft for driving said second camshaft, and tensioning means adjacent said chain drive means for changing the relative rotating position of said second camshaft with respect to said first camshaft.

20. A camshaft drive according to claim 19, wherein said belt drive means engages said first camshaft at an end region of said camshaft and said chain drive means engages said first camshaft at a central region thereof.

21. A camshaft drive according to calim 19, wherein said first flexible drive means engages said first camshaft at an end region of said camshaft and said second flexible drive means engages said first camshaft at a central region thereof.

22. A camshafts drive for an internal combustion engine having a cylinder head with first, second, third and fourth camshafts and a crankshaft, comprising:

belt drive means directly connecting said first camshaft and said third camshaft with said crankshaft for driving said first camshaft and said third chamshaft, first chain drive means connecting said first camshaft with said second camshaft for driving said second camshaft, second chain drive means connecting said third camshaft with said fourth camshaft for driving said fourth camshaft, and chain tensioning means engageable with said first and second chain drive means, said tensioning means being capable of adjusting tension in said chain dirve and adjusting control time of valves in said engine.

23. A camshaft drive according to claim 22, wherein said belt drive means engages said first and third camshafts at end regions of said shafts and said chain drive means engages said camshafts at central regions of said shafts.

24. A method of driving camshafts of an internal combustion engine having first and second camshafts and a crankshaft comprising:

driving said first camshaft with a belt drive connecting said first camshaft and said crankshaft, driving said second camshaft with a chain drive connecting said first camshaft and said second camshaft, and applying tensioning means to said chain drive means for changing the relative rotating position of said second camshaft with respect to said first camshaft.

25. A method of driving camshafts of an internal combustion engine having first, second, third and fourth camshafts, comprising:

directly driving said first and said third camshafts with a belt drive connecting said first and third camshafts with said crankshaft, driving said second camshaft with a first chain drive connecting said first camshaft and said second camshaft, driving said fourth camshaft with a second chain drive connecting said third camshaft and said fourth camshaft, and controlling tension in said chain drives and controlling timing of engine valves by selectively applying chain tensioning means to said first and second chain drives.

* * * * *